US008448691B1

(12) United States Patent
Pinkstock et al.

(10) Patent No.: US 8,448,691 B1
(45) Date of Patent: May 28, 2013

(54) BEARING HOUSING MOLDING APPARATUS AND METHOD

(75) Inventors: Steven R. Pinkstock, Amanda, OH (US); Bruce Milligan, Newark, OH (US); Ronald A. Poe, Columbus, OH (US)

(73) Assignee: Columbus Steel Castings Company, Columbus, OH (US)

( * ) Notice: Subject to any disclaimer, the term of this patent is extended or adjusted under 35 U.S.C. 154(b) by 303 days.

(21) Appl. No.: 12/504,620

(22) Filed: Jul. 16, 2009

Related U.S. Application Data

(60) Provisional application No. 61/081,375, filed on Jul. 16, 2008.

(51) Int. Cl.
*B22C 9/10* (2006.01)
*B22D 33/04* (2006.01)

(52) U.S. Cl.
USPC ..... 164/137; 164/349; 164/350; 164/351

(58) Field of Classification Search
USPC ..... 164/113, 137, 349, 350, 351
See application file for complete search history.

(56) References Cited

U.S. PATENT DOCUMENTS

| | | | | |
|---|---|---|---|---|
| 2,299,016 | A * | 10/1942 | Hagemeyer | 164/137 |
| 4,609,030 | A * | 9/1986 | Heater et al. | 164/137 |
| 5,263,533 | A * | 11/1993 | Druschitz et al. | 164/363 |
| 6,622,776 | B2 * | 9/2003 | Bauer et al. | 164/137 |

FOREIGN PATENT DOCUMENTS

JP 11101253 A * 4/1999

* cited by examiner

*Primary Examiner* — Nicholas P D'Aniello
(74) *Attorney, Agent, or Firm* — Standley Law Group LLP

(57) ABSTRACT

This invention teaches an improved apparatus and method to make metal alloy castings, such as subway car undercarriage bearing housings. One embodiment of the invention comprises a core mold assembly unit, wherein the mold unit is filled with molten metal. The core mold assembly units may be further formed of the same material, such as phenolic urethane impregnated sand, which is used to accurately replicate the desired shape of a final desired product.

5 Claims, 3 Drawing Sheets

BEARING HOUSING MOLDING APPARATUS AND METHOD

CROSS REFERENCE TO RELATED APPLICATIONS

This application is a non-provisional of, and makes claim of the benefit of priority to, US provisional patent application Ser. No. 61/081,375, filed 16 Jul. 2008, which is incorporated by reference as if fully recited herein.

INVENTIVE FIELD

The present invention relates generally to a method and apparatus for use in casting, particularly a method and apparatus for more efficiently producing castings of items such as subway car undercarriage bearing housings.

BACKGROUND OF THE INVENTIVE FIELD

Casting methods currently used to produce items of metal alloys employ molding techniques that replicate the interior and exterior features of a desired part. Such methods comprise an exterior mold that replicates the external surface features of the desired part, while a core or cores are used to replicate interior cavities and surfaces if such parts embody hollow or reentrant features. The mold and cores are produced from a pattern of the part and are assembled together to produce a cavity that replicates the volume and surface features of the desired part. Cores are subsequently placed within the mold and the mold halves fitted together to form a core mold assembly. A system of sprues, runners, gates and risers embodied within the core mold assembly provide the requisite channels to direct molten metal poured into the formed part cavity to reproduce the part. Molten metal is poured into the core mold assembly and is allowed to cool and solidify. Once the casting has cooled sufficiently, the cast part is shaken from the sand mold and the cores removed leaving the desired replicated part. The mold and core sand are usually reclaimed and reused.

Of the various types of molding methods used, molds made from "green sand" are the most widely used. Green sand is made from a pliable mixture of sand, clay, and water that coheres and can be molded in such a fashion as to faithfully replicate surface features of the part pattern shape. However, significant disadvantages are associated with the green sand method, some of which are the need for careful handling of the core mold assembly due to the relative fragility of the green sand, as well as undesirable dimensional variations between castings associated with mold cavity, core misalignment and pattern wear. Additionally, green sand molding techniques typically employ core sand compositions that differ from molding sand making reclamation of these components difficult in that they are mixed during the part removal process and thus can cross-contaminate each other. Furthermore, multiple parts are typically cast at one time by using a plurality of part patterns to form several mold cavities within a single flask (i.e., frame) using a system of common runners. Such an arrangement increases the number of parts that may need to be scrapped due to core mold assembly misalignments and cold-shunting. What is needed is an improved casting apparatus and method to overcome these and other drawbacks.

SUMMARY OF THE GENERAL INVENTIVE CONCEPT

Exemplary embodiments of the casting apparatus and methods disclosed herein address traditional shortcomings of green sand molding by employing a variation on the phenolic urethane cold-box system to produce stronger molds and cores of higher dimensional accuracy. Although other core and mold making methods may be embodied within this invention, the cold-box method employs molding sand impregnated with phenolic urethane "no-bake" (hence "cold-box") binders typically used to form molding cores. One principal advantage of using a phenolic urethane binder is that it can be rapidly catalyzed at room temperature by means of an amine vapor that is blown through the core sand to produce durable cores. Removal of the core from the cast part is facilitated by carefully controlling the composition of the phenolic urethane impregnated sand and the curing conditions. An embodiment extends the use of the cold-box method to include forming the mold as well as the core resulting in a sturdy core mold assembly that has superior dimensional stability as well as improved structural integrity that permits more aggressive handling of mold than is possible when using a relatively fragile green sand. Furthermore, this approach reduces the likelihood of misalignments in a core mold assembly and improves the finish of the cast part, consequently reducing finishing costs and part scrap rate. Moreover, with the tolerances desired during fabrication of subway car undercarriage bearing housings, there may be no additional finishing required after casting. Additionally, depending on the part geometry, exemplary embodiments also may reduce the number of needed cores used to produce a cast part. In contrast to multiple-part green sand molding methods, exemplary embodiments also may be employed to form individual or modular core mold assembly units used to form individual parts.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
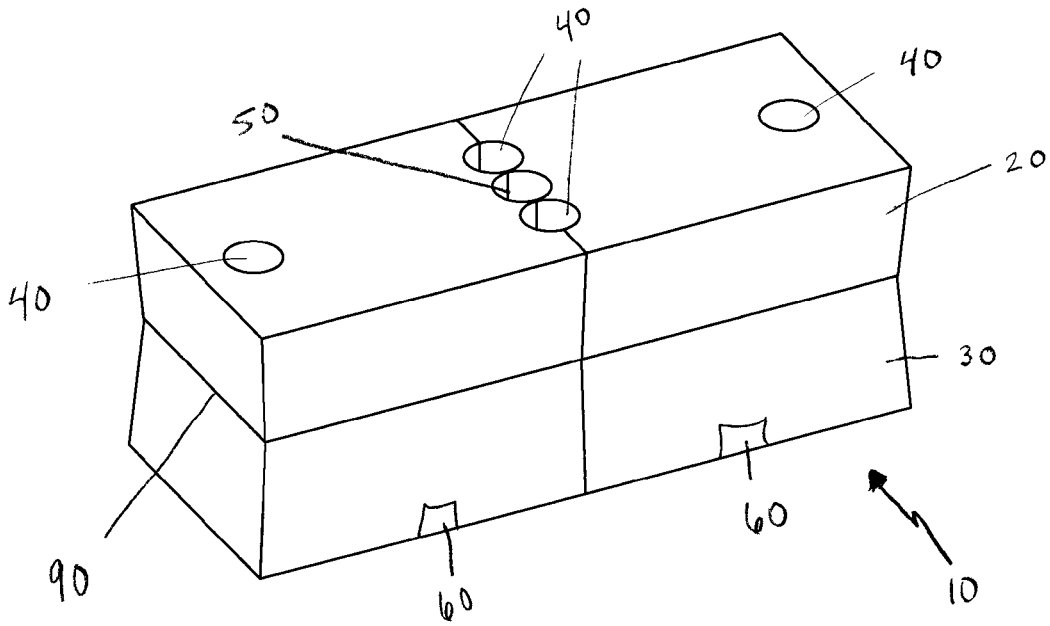
FIG. 1 is a perspective view of one exemplary embodiment of the present invention illustrating a core mold assembly unit.

Exemplary embodiments of the molding apparatus and method are directed to casting technology. In addition, the apparatus and method involves the use of a core mold assembly unit to produce independently formed parts. FIG. 1 shows an example of a core mold assembly unit 10, which comprises a core mold upper half 20, a core mold lower half 30, riser vents 40, a filling gate 50, a handling groove or grooves 60, and split line 90.

Figure 2:
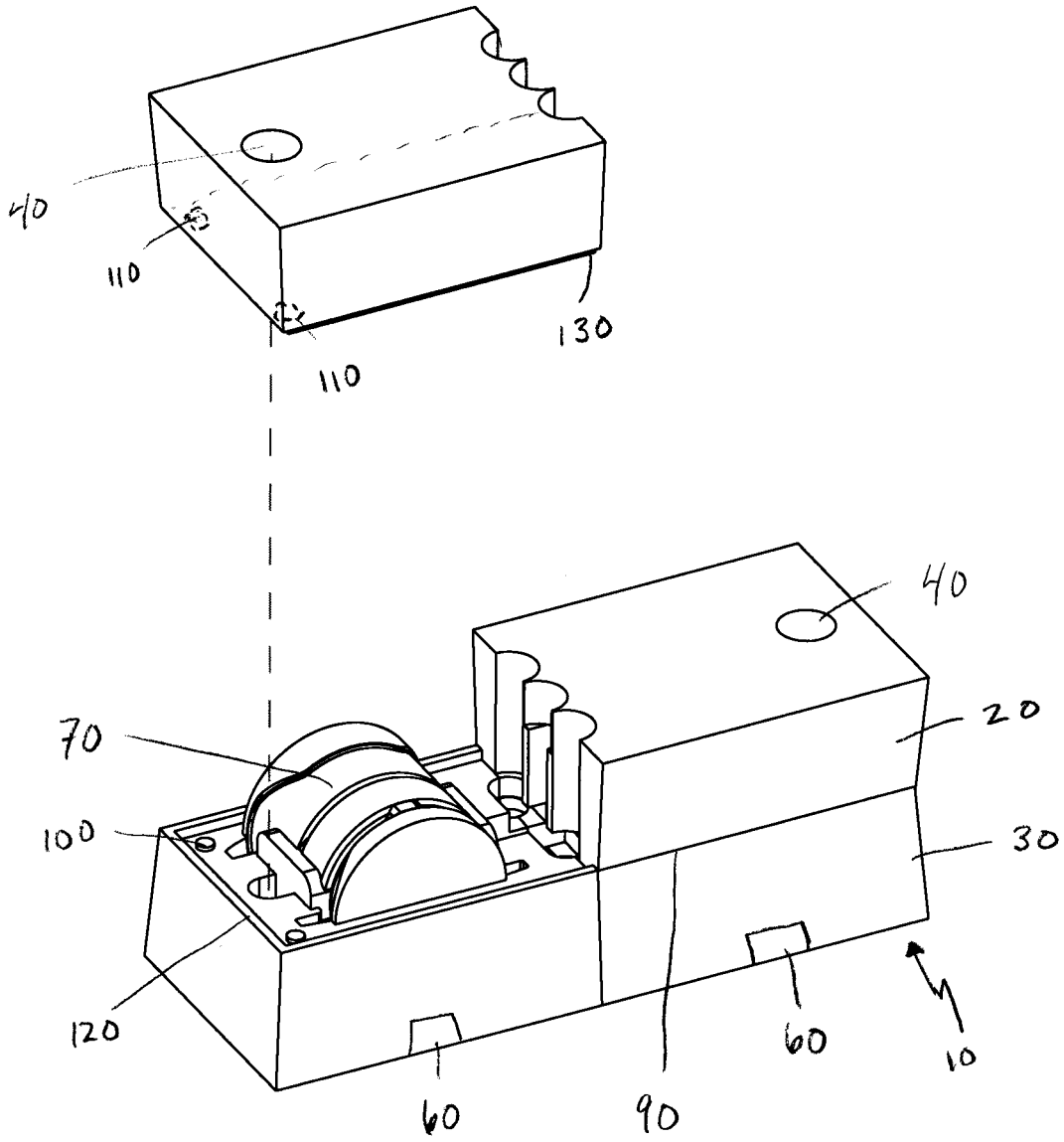
FIG. 2 shows the exemplary embodiment of FIG. 1, illustrating core mold assembly unit elements separated across the core mold assembly split line, thereby exposing details of the internal components and features of the assembly.
Figure 3:
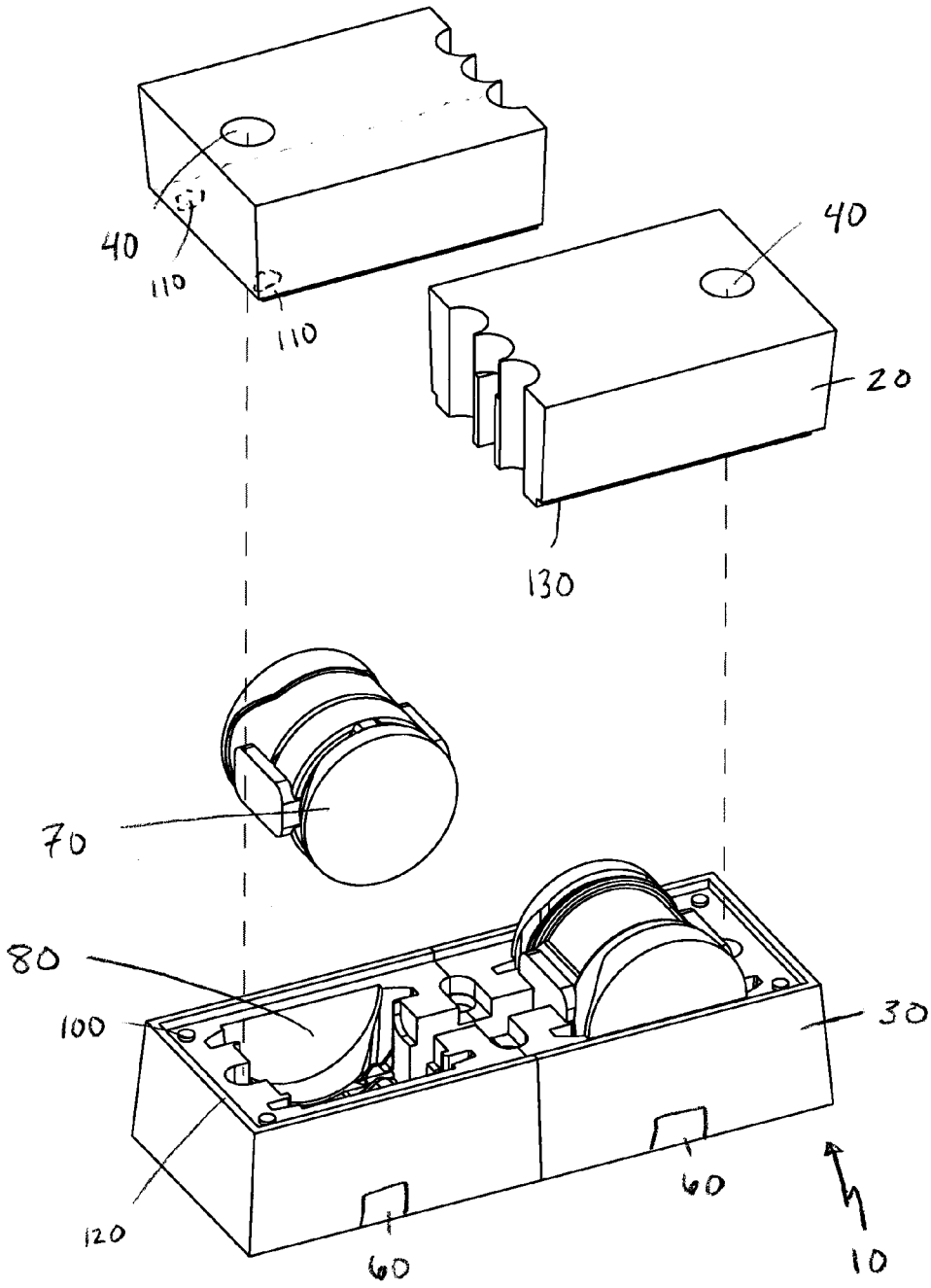
FIG. 3 is a partially exploded view of the exemplary embodiment of FIG. 1, further illustrating core mold assembly unit elements and details of the internal components and features of the assembly.

FIGS. 2 and 3 further illustrate the core mold assembly unit 10 separated into a core mold assembly unit upper half 20 and a core mold assembly unit lower half 30 along the split line 60. FIGS. 2 and 3 reveal the internal details of a core assembly 70 and mold cavity 80, which in this example, represents the molding features of subway car undercarriage bearing housings. In one preferred embodiment, the core mold assembly unit 10 is comprised of phenolic urethane treated molding sand, which lends itself to fabrication using the cold-box system. Using this technique, sand may be blown onto replicate patterns of the desired part within individual cope and drag flasks and catalyzed with an amine vapor to enhance its mechanical properties, thereby forming relatively durable core mold components 20, 30 and a mold cavity 80 that accurately replicates the external features of the part. The core or cores 70, used to replicate the internal features of a part, may be produced using the same method (i.e., cores are made in a cold box from phenolic urethane treated molding sand) depending on the need for such as dictated by the part geometry. To reduce the effects of pattern wear and consequent irregularity between castings, one exemplary embodiment of the invention employs durable cast-iron or steel patterns to replicate the desired geometry and features of part cavity 80 and core or cores 70 within the phenolic urethane treated molding sand during the core mold assembly unit 10 fabrication process.

Exemplary embodiments of a core mold assembly unit 10 may include handling grooves (e.g., grooves 60) to provide a means to easily lift and transport the core mold assembly unit 10. While not shown herein, it can be understood that such grooves may pass fully through the core mold assembly lower half. The filling gate 50 provides an entryway for the introduction of molten metal into the core mold assembly unit 10. The riser vents 40 provide for venting of the core mold assembly unit 10 during molten metal insertion.

Exemplary embodiments of the molding assembly unit 10 may include a protrusion 100 on the upper face of the core mold lower half 30 that has a complementary receiving cavity 110 on the lower face of the core mold upper half 20. In this particular embodiment, the core mold lower half 30 has four protrusions 100 that are positioned towards the corners of the core mold lower half 30. Also, the core mold upper half 20 has four complementary receiving cavities 110 that are positioned towards the corner of the core mold upper half 20. Furthermore, exemplary embodiments may include a ridge 120 located along the outer edge of the upper face of the core mold lower half 30 that has a complementary receiving edge 130 located on the outer edge of the lower face of the core mold upper half 20. The use of such protrusions 100 and complementary receiving cavities 110 and/or a ridge 120 and complementary receiving edge 130, facilitates the alignment of the core mold upper half 20 to the core more lower half 30 during the production of subway car undercarriage bearing housings.

During a casting operation, molten metal is poured into a filling gate 50, as shown in FIG. 1, which subsequently flows into the core mold assembly unit cavity 80. The pouring of molten metal is typically continued until molten metal is observed to approach or exit the riser vents 40 thus ensuring that core mold assembly unit cavities 80 are completely filled to form the desired part. In this particular embodiment, the core mold assembly unit 10 produces two substantially identical subway car undercarriage bearing housings.

A molding method and apparatus of the present invention may eliminate the need for pattern gauging. Also, such a molding method and apparatus may improve component alignment, reduce the amount of casting defects, and lower the scrap rate caused by misaligned core mold halves. Furthermore, such a method and apparatus may permit more aggressive handling of molding components, thereby improving part production rate. As a result of practicing the present invention, the dimensional stability of parts from casting to casting may be improved, thereby reducing the finishing cost for parts produced (sometimes eliminating the need for an additional finishing step(s)). The reclamation of molding and core sand is also facilitated by practicing the present invention. Also, the number of cores needed may in some cases be reduced and the core or core assemblies within the mold cavity may be simplified.

It should be noted that the exemplary embodiments shown and described herein are not to be considered limiting or restrictive in any fashion. Rather, a number of core mold assembly units and possible casting configurations may be practiced, as would be understood by those skilled in the art.

While certain embodiments of the present invention are described in detail above, the scope of the invention is not to be considered limited by such disclosure, and modifications are possible without departing from the spirit of the invention as evidenced by the following claims:

What is claimed is:

1. A method for casting a subway car undercarriage bearing housing using a core mold assembly unit, the method comprising:

providing a core mold assembly unit made from phenolic urethane treated molding sand, the core mold assembly unit including a core mold upper half and a core mold lower half, at least one riser vent in the core mold upper half to allow venting of said core mold assembly unit, the core mold upper and lower halves mated at a common split line defining a mold, at least one filling gate in the core mold upper half, at least one mold cavity which replicates the exterior features of a cast subway car undercarriage bearing housing, and at least one core located inside the mold cavity that replicates the interior features of a cast subway car undercarriage bearing housing, the core mold lower half includes a ridge located along the entire outer edge of an upper face thereof and the core mold upper half has a complementary receiving edge located on the entire outer edge of a lower face thereof; and pouring molten metal through the filling gate and into the core assembly unit through the core mold assembly unit filling gate, thereby filling the core mold assembly unit cavity to cast at least two subway car undercarriage bearing housings are produced during the same pouring step.

2. The casting method of claim 1, wherein the core mold assembly unit includes a groove feature facilitate ease of handling the core mold assembly unit to lift and transport the core mold assembly unit.

3. The casting method of claim 1, wherein the core mold lower half includes a protrusion and the core mold upper half includes a complementary receiving cavity.

4. The casting method of claim 1, wherein the pouring of the molten metal continues until molten metal is observed to approach or exit at least one riser vent.

5. A method for casting a subway railcar undercarriage bearing housing using a core mold assembly unit, the method comprising:

providing a core mold assembly unit made from phenolic urethane treated molding sand, the core mold assembly unit including a core mold upper half and a core mold lower half, at least one riser vent in the core mold upper half to allow venting of said core mold assembly unit, the core mold upper and lower halves mated at a common split line defining a mold, at least one filling gate in the core mold upper half, at least one mold cavity which replicates the exterior features of a cast subway car undercarriage bearing housing, and at least one core located inside the mold cavity that replicates the interior features of a cast subway car undercarriage bearing housing, the core mold lower half includes a ridge located along the entire outer edge of an upper face thereof and the core mold upper half has a complementary receiving edge located on the entire outer edge of a lower face thereof, the core mold assembly unit includes a groove feature, the core mold lower half includes a protrusion and the core mold upper half includes a complementary receiving cavity, the bearing housing adapted to accept a bearing and to mate with the lower surface of a subway car sideframe pedestal; and pouring molten metal through the filling gate and into the core assembly unit through the core mold assembly unit filling gate until molten metal is observed to approach or exit at least one riser vent, thereby filling the core mold assembly unit cavity to cast at least two subway car undercarriage bearing housings are produced during the same pouring step.

* * * * *

UNITED STATES PATENT AND TRADEMARK OFFICE

CERTIFICATE OF CORRECTION

PATENT NO. : 8,448,691 B1
APPLICATION NO. : 12/504620
DATED : May 28, 2013
INVENTOR(S) : Pinkstock et al.

It is certified that error appears in the above-identified patent and that said Letters Patent is hereby corrected as shown below:

In the Claims

In column 4, line 47, please insert -- to -- between the words “feature” and “facilitate”.

Signed and Sealed this
Third Day of September, 2013

Teresa Stanek Rea
*Acting Director of the United States Patent and Trademark Office*